US007204757B2

(12) United States Patent
Newton et al.

(10) Patent No.: US 7,204,757 B2
(45) Date of Patent: Apr. 17, 2007

(54) WAGERING GAME

(75) Inventors: Michael John Newton, Innaloo (AU); Mark Lawson, Glendalough (AU); Cecilia Jenny Tollet, Glendalough (AU)

(73) Assignee: Entertainment Programmes Pty Ltd., Midland, Western Australia (AU)

( * ) Notice: Subject to any disclaimer, the term of this patent is extended or adjusted under 35 U.S.C. 154(b) by 851 days.

(21) Appl. No.: 10/297,569

(22) PCT Filed: Jun. 8, 2001

(86) PCT No.: PCT/AU01/00684

§ 371 (c)(1),
(2), (4) Date: Jun. 13, 2003

(87) PCT Pub. No.: WO01/93964

PCT Pub. Date: Dec. 13, 2001

(65) Prior Publication Data

US 2004/0033825 A1 Feb. 19, 2004

(30) Foreign Application Priority Data

Jun. 9, 2000 (AU) ..... PQ8053
Sep. 29, 2000 (AU) ..... PR0450

(51) Int. Cl.
*A63F 9/24* (2006.01)

(52) U.S. Cl. ..... 463/25; 463/16; 273/309; 273/292

(58) Field of Classification Search ..... None
See application file for complete search history.

(56) References Cited

U.S. PATENT DOCUMENTS

| | | | | |
|---|---|---|---|---|
| 5,540,442 A | | 7/1996 | Orselli et al. | 463/17 |
| 5,653,444 A | | 8/1997 | Dahl | 273/274 |
| 5,746,432 A | | 5/1998 | Feola | 273/274 |
| 5,806,847 A | * | 9/1998 | White et al. | 273/309 |
| 6,062,563 A | | 5/2000 | De Keller | 273/274 |

FOREIGN PATENT DOCUMENTS

GB 2291360 1/1996

* cited by examiner

*Primary Examiner*—Mark Sager
(74) *Attorney, Agent, or Firm*—Duane Morris LLP

(57) ABSTRACT

A wagering game for one or more players comprising (a) a random result generator for generating a specific random result, and (b) a playing surface (100) including a first betting zone (20) for placement of first wagers corresponding to a plural of likely random results; and a second betting zone (30) for placement of second wagers corresponding to a first or second outcome wherein the likely random result is compared to the specific random result for a match and the first or second outcomes are determined by a comparison of the specific random result with either a predetermined specific random result or a successive specific random result.

19 Claims, 3 Drawing Sheets

WAGERING GAME

FIELD OF THE INVENTION

The present invention relates to a wagering game.

BACKGROUND OF THE INVENTION

Casino operators recognise that there are many elements comprised in a wagering game that contribute not only to its popularity amongst players but to its financial profitability. For example, most casinos around the world seek to provide a broad variety of wagering games to maintain the betting public's interest, including games played with playing cards, such as Black Jack and poker, games played with roulette wheels, games played with dice, and slot machines. It is also important to provide a variety of betting options within the game itself, to cater for players with varying degrees of risk taking. Ideally, the game should be interesting, exciting and fast paced with frequent wagers being placed and decided at each outcome of the game. It is well recognised that the profitability of the casino increases in proportion with the number of wagers placed per hour. At the same time, the game should be able to be played with simple rules which players, experienced or otherwise, have little difficulty in learning and following. The ease of play of the game is also likely to encourage new and frequent players to participate, thereby contributing to increased casino profitability.

One of the most well known dice games is the game of craps. Part of its initial popularity was drawn from the fact that it is one of the few casino games in which the player can operate the dice. One of the most appealing and desirable features of any gaming activity is the ability for a member of the betting public to directly participate in determining the outcome of wagers. Although craps has a reputation of being one of the fastest and most exciting table games offered by casinos, the rules of the game and the various betting schemes are complicated. The conventional pace of the craps game is generally so fast that the uninitiated beginner has little opportunity to grasp the rules and nuances of the game either by casually observing the game being played by others or by participating himself. Thus, craps has developed a reputation for being difficult to learn and play. Anecdotal evidence suggests that there is a decline in popularity for the craps game, and although most casinos will own several craps games tables, the tables are more likely to be in storage to allow more floor space on the casino floor for more popular (and thus more profitable) wagering games.

The present invention attempts to overcome at least in part some of the aforementioned disadvantages.

U.S. Pat. No. 5,806,847, which discloses a wagering game employing dice for multiple players, seeks to provide a simplified version of the conventional craps game in which all wagers are decided on the outcome after each and every roll of the dice.

In contrast the present invention provides a game in which a player may not only place a bet on the outcome of the roll of the dice but may simultaneously, or alternatively, place a bet on whether the player who rolls the dice will obtain an outcome that is equal to or higher than a predetermined outcome. The present invention is also readily adapted to a two-player version in which players not only place a bet on the outcome of the roll of the dice, or a dealt hand of cards, but may simultaneously, or alternatively, place a bet on whether a first player will obtain an outcome which is equal to or higher than the outcome of a second player, and vice versa.

SUMMARY OF THE INVENTION

In accordance with a first aspect of the present invention there is provided a wagering game, comprising a random result generator, operated by one player, for generating a specific random result from a finite set of random results, some random results being more likely than others; and a playing surface including a first betting zone corresponding to a plurality of likely random results, wherein a first wager placed in the first betting zone is won if the specific random result matches the likely random result wagered in the first betting zone; and a second betting zone, for placement of a second wager, corresponding to a first outcome and a second outcome, wherein the first and second outcomes correspond to a comparison of the specific random result with a predetermined specific random result.

In accordance with a second aspect of the present invention there is provided a wagering game, comprising a random result generator, operated by a first player for generating a first specific random result from a finite set of random results and a second player for generating a second specific random result from a finite set of random results, some random results being more likely than others; and a playing surface including a first betting zone corresponding to a plurality of likely random results, wherein a first wager placed in the first betting zone is won if the first or second specific random result matches the likely random result wagered in the first betting zone; and a second betting zone, for placement of a second wager, corresponding to a first outcome and a second outcome, wherein the first and second outcomes correspond to a comparison of the first specific random result with the second specific random result.

BRIEF DESCRIPTION OF THE DRAWINGS

The present invention will now be described, by way of example only, with reference to the accompanying drawings, in which.

DETAILED DESCRIPTION OF THE PREFERRED EMBODIMENTS

Figure 1:
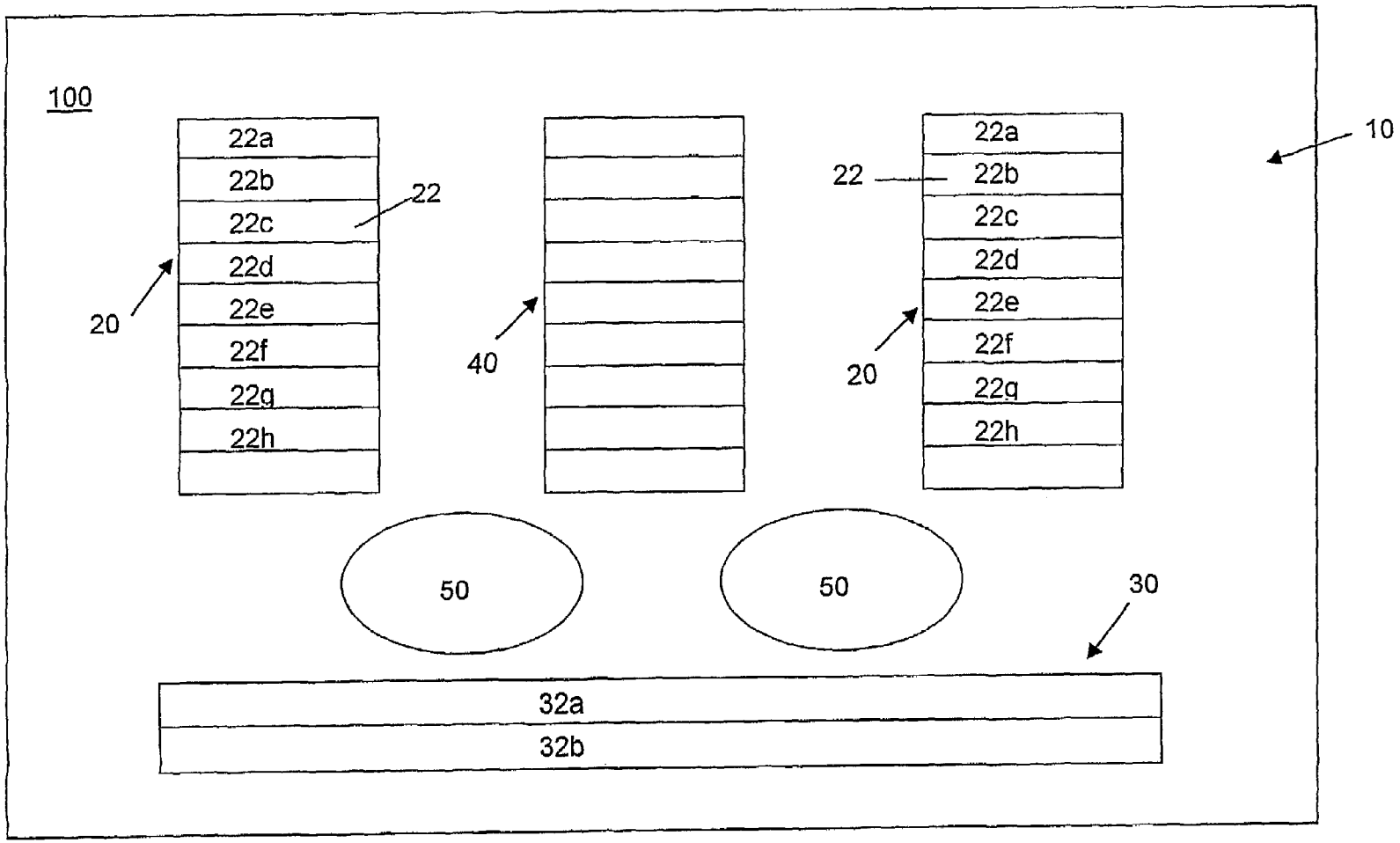
FIG. 1 is a diagrammatic plan view of a playing surface used in a first embodiment of the wagering game in accordance with the present invention.
Figure 2:
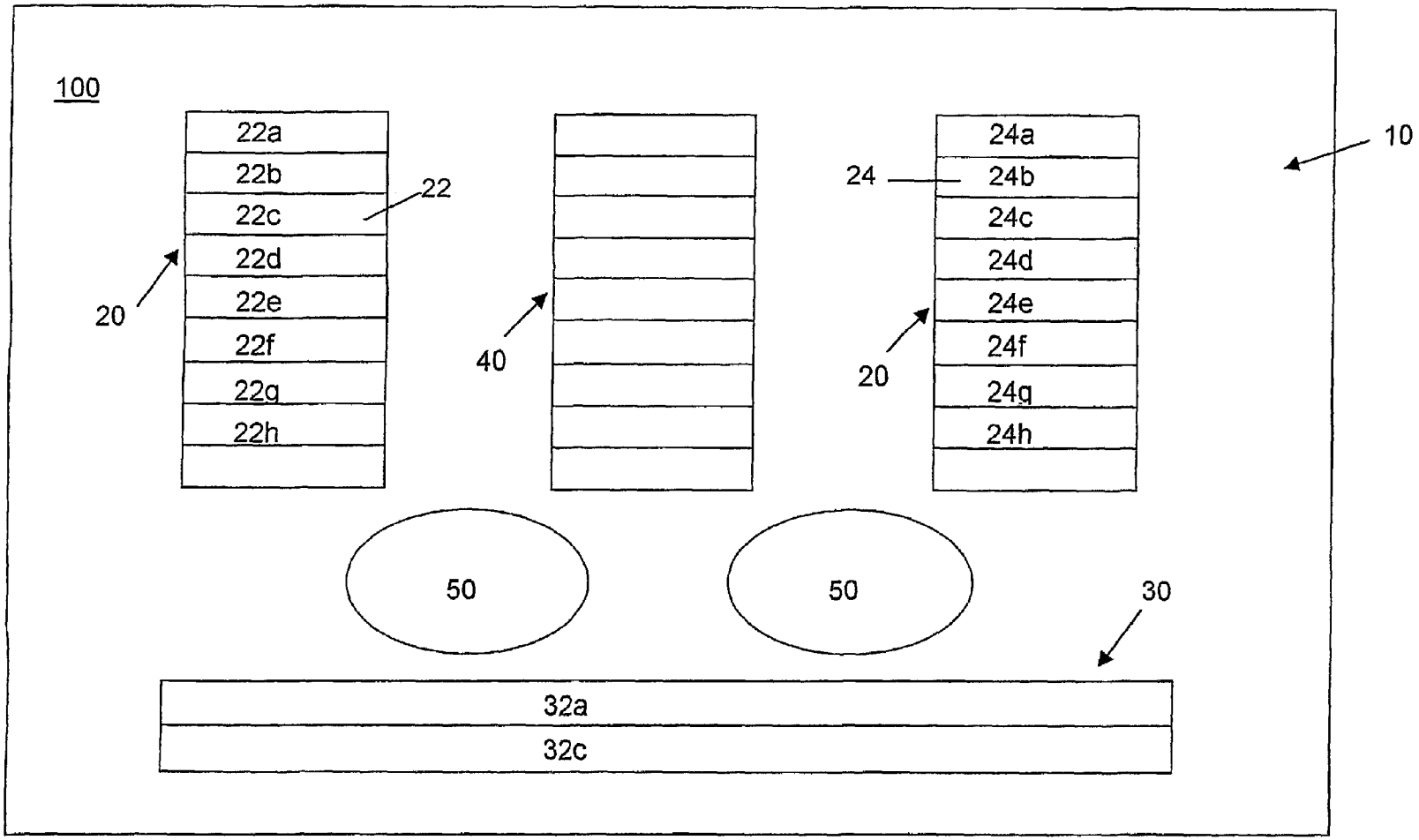
FIG. 2 is a diagrammatic plan view of a playing surface used in a second and fourth embodiment of the wagering game in accordance with the present invention.
Figure 3:
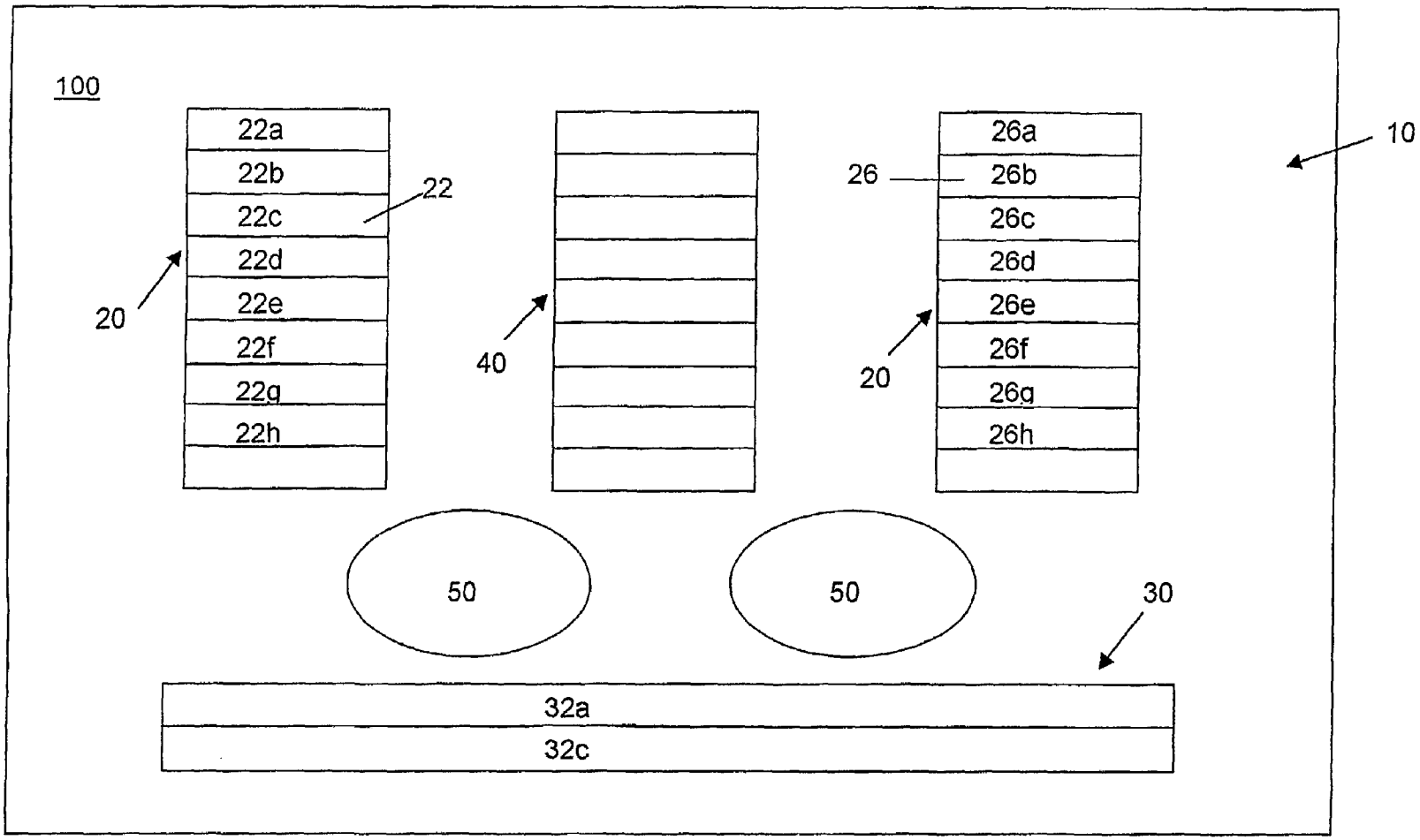
FIG. 3 is a diagrammatic plan view of a playing surface used in a third embodiment of the wagering game in accordance with the present invention.

Referring to FIGS. 1–3, wherein like numerals and symbols refer to like parts throughout, there is shown a playing surface 100 for a wagering game 10. In a preferred embodiment of the invention, the playing surface 100 will be formed from a felt-like fabric and will be easily adapted for use on existing casino equipment, in particular on redundant craps tables. The playing surface 100 is also readily adapted for use on Blackjack style tables. However, it is also within the scope of the invention for the playing surface 100 to be represented graphically using electronic media, such as for instance in a video game adaptation of the wagering game 10 or as an on-line casino game played by means of a electronic telecommunications network.

The wagering game 10 includes a random result generator, such as a plurality of identical hexahedral dice, each die having indicia on the faces thereof. In the first three embodiments of the invention as described herein, a set of five hexahedral dice is provided for the play of the wagering game 10.

In a fourth embodiment of the invention as described herein, a customised deck of 40 playing cards including eight aces, eight kings, eight queens, eight jacks, and eight tens is provided for the play of the wagering game 10. It will be understood that a hand of five cards may be dealt manually or with a blinded shuffle machine.

In alternative embodiments of the invention the random result generator will be understood to include electronic dice, playing cards, and electronic playing cards having indicia on the faces thereof. The indicia include numeric, alphabetic, or pictorial symbols, colours, or other symbols.

In the first embodiment of the invention only one player is permitted to cast the five dice to obtain a specific random result. The casting player may also place a first wager corresponding to a likely random result. Other players may also place first wagers corresponding to any of the plurality of likely random results. The success of the first wagers is determined by a match between the specific random result cast by the casting player and the likely random result wagered by the casting player and/or the other players.

The players may also place second wagers corresponding to a first outcome or a second outcome. The first outcome corresponds to the specific random result that is equal to or higher than a predetermined specific random result. The second outcome corresponds to the specific random result that is lower than the predetermined specific random result. In this way, the second wagers are determined by a comparison of the specific random result obtained by the casting player with a predetermined specific random result.

In the second embodiment of the invention a first set and a second set of five dice are provided. A banker of the casino is permitted to cast the first set of five dice to obtain a first specific random result and a player is permitted to cast the second set of five dice to obtain a second specific random result. The players may place first wagers corresponding to any of the plurality of likely random results in relation to the first specific random result or the second specific random result. The success of the first wagers is determined by a match between the first specific random result and the likely random result wagered by the players and/or a match between the second specific random result and the likely random result wagered by the players.

The players may also place second wagers corresponding to a first outcome or a second outcome. The first outcome corresponds to the first specific random result being higher than the second specific random result. The second outcome corresponds to the second specific random result being higher than the first specific random result. In this way, the second wagers are determined by a comparison of the first and second specific random results.

In the third embodiment of the invention a first player is permitted to cast the first set of five dice to obtain the first specific random result and a second player is permitted to cast the second set of five dice to obtain the second specific random result. The players may place first wagers corresponding to any of the plurality of likely random results in relation to the first specific random result or the second specific random result. The success of the first wagers is determined by a match between the first specific random result and the likely random result wagered by the players and/or a match between the second specific random results and the likely random result wagered by the players. The players may also place second wagers corresponding to a first outcome or a second outcome. The first outcome corresponds to the first specific random result being higher than the second specific random result. The second outcome corresponds to the second specific random being higher than the first specific random result. In this way, the second wagers are determined by a comparison of the first and second specific random results.

In the fourth embodiment of the invention the banker is dealt a first set of five cards to obtain the first specific random result and a player is dealt a second set of five cards to obtain the second specific random result. The players may place first wagers corresponding to any of the plurality of likely random results in relation to the first specific random result or the second specific random result. The success of the first wagers is determined by a match between the first specific random result and the likely random result wagered by the players and/or the second specific random result and the likely random result wagered by the players.

The players may also place second wagers corresponding to a first outcome or a second outcome. The first outcome corresponds to the first specific random result being higher than the second specific random result. The second outcome corresponds to the second specific random being higher than the first specific random result. In this way, the second wagers are determined by a comparison of the first and second specific random results.

The playing surface 100 includes a plurality of betting zones for different wagering purposes, namely at least one first betting zone 20 for placement of first wagers, at least one second betting zone 30 for placement of second wagers, at least one third betting zone 40 for placement of third wagers, and at least one fourth betting zone 50 for placement of fourth wagers.

Referring to FIG. 1, the first betting zone 20 includes a plurality of first betting areas 22, each first betting area 22 corresponding to the specific random result obtained by the random result generator. Each first betting area 22 is provided with markings to clearly indicate the corresponding specific random result and the designated odds paid if a successful first wager is placed in that particular first betting area 22. Typically, the designated odds are longer for the specific random result that has less probability of occurring. In this way, the longest odds are designated for the specific random results least likely to occur.

However, it is also within the scope of the present invention for the designated odds to be assigned to the specific random results that occur in a sequential order of "winning hands" as in a poker set up. In the embodiments of the wagering game 10 described herein, there is provided a first betting area 22*a* corresponding to "five of a kind" wherein the specific random result comprises all upwardly turned faces of the dice or cards showing identical indicia; a first betting area 22*b* corresponding to "four of a kind" wherein the specific random result comprises at least four upwardly turned faces of the dice or cards showing identical indicia; a first betting area 22*c* corresponding to a "straight" wherein the specific random result comprises all upwardly turned faces of the dice or cards showing indicia in sequential order (for example, 1, 2, 3, 4, 5 or 2, 3, 4, 5, 6, or A, K, Q, J, 10); a first betting area 22*d* corresponding to a "full house" wherein the specific random result comprises three upwardly turned faces of the dice or cards showing identical indicia and the two remaining upwardly turned faces of the dice or cards showing identical indicia; a first betting area 22*e* corresponding to "three of a kind" wherein the specific random result comprises at least three upwardly turned faces of the dice or cards showing identical indicia; a first betting area 22*f* corresponding to "two pair" wherein the specific random result comprises a first set of two upwardly turned faces of the dice or cards showing an identical indicia and a second set of two upwardly turned faces of the dice or cards showing an identical indicia, wherein the indicia shown by the first and second set of faces may be the same or different; a first betting area 22*g* corresponding to "a pair" wherein the specific random result comprises at least two upwardly turned faces of the dice or cards showing identical indicia; and a first betting area 22*h* corresponding to a "deadman's hand" wherein the specific random result comprises all of the upwardly turned faces of the dice showing different indicia in non-sequential order.

In embodiments of the invention wherein the random result generator is a pack of cards, the first betting area 22*h* corresponding to the "deadman's hand" is considered to be an option. It is also within the scope of the invention for the first betting areas 22*e*, 22*f*, 22*g* to be further subdivided into additional first betting areas for placement of first wagers, wherein each subdivision corresponds to specific indicia, for example "three 6's" or "two J's".

The second betting zone 30 includes a plurality of second betting areas 32 for placement of second wagers. In the first embodiment of the invention each second betting area 32*a* and 32*b* corresponds, respectively, to the first outcome and the second outcome. The first outcome, in this specific embodiment, is defined as the specific random result which is equal to or greater than two pairs of the same indicia, wherein the indicia are the same or different. The second outcome, in this specific embodiment, is defined as the specific random result that is less than two pairs of the same indicia. Each second betting area 32 is provided with markings to clearly indicate the corresponding outcome and the designated odds paid if a successful second wager is placed in that particular second betting area 32.

In the first embodiment of the invention, prior to the player operating the random result generator casting the dice, the players place the first wagers on one or more first betting areas 22 and the second wagers on the second betting area 32*a* or 32*b* on the playing surface 100. Once all the players have completed placing their first and/or second wagers, the player operating the random result generator is then permitted to roll the set of five dice to obtain the specific random result. Depending on which indicia are shown on the upwardly turned faces of the dice some of the first wagers will win and other first wagers will lose. Successful first wagers are defined as those placed on the first betting areas 22 that correspond to the specific random result of the five dice. It is envisaged that successful first wagers will be paid according to the odds designated in the corresponding first betting areas 22. Unsuccessful first wagers are defined as those placed on first betting areas 22 that do not correspond to the specific random result of the five dice. It is envisaged that unsuccessful first wagers will be retained by the casino banker.

If the specific random result is equal to or greater than two pairs of the same indicia, wherein the indicia are the same or different, second wagers placed on second betting area 32*a* will be paid out. If the specific random result is less than two pairs of the same indicia, second wagers placed on second betting area 32*b* will be paid out. Referring to FIG. 2 and the second and fourth embodiments of the invention, the first betting zone 20 is provided with a plurality of first betting areas 22, each first betting area 22 corresponding to the first specific random result obtainable by the banker, and a plurality of first betting areas 24, each first betting area 24 corresponding to the second specific random result obtainable by the player. Each first betting area 24 is provided with markings identical with first betting area 22 to clearly indicate the corresponding second specific random result and the designated odds paid if a successful first wager is placed in that particular first betting area 24.

The second betting zone 30 includes a plurality of second betting areas 32 for placement of second wagers. In the second and fourth embodiments of the invention each second betting area 32 corresponds to the first outcome 32*a* or the second outcome 32*c*. Each second betting area 32 is provided with markings to clearly indicate the corresponding outcome and the designated odds paid if a successful second wager is placed in that particular second betting area 32.

In the second and fourth embodiments of the invention, prior to casting the dice, players place first wagers on one or more first betting areas 24 or 22, and/or second wagers on second betting areas 32*a* or 32*c* on the playing surface 100. Once all the players have completed placing their first and/or second wagers, the banker of the casino is then permitted to roll the first set of five dice (or is dealt the first set of five cards) to obtain the first specific random result and the player operating the random result generator is then permitted to roll the second set of five dice (or is dealt the second set of five cards) to obtain the second specific random result. Depending on which indicia are shown on the upwardly turned faces of the dice or cards, some of the first wagers will win, and other first wagers will lose. Successful first wagers are defined as those placed on the first betting areas 22, 24 that correspond to the first and the second specific random results, respectively. It is envisaged that successful first wagers will be paid according to the odds designated in the corresponding first betting areas 22, 24. Unsuccessful first wagers are defined as those placed on first betting areas 22, 24 that do not correspond to the first and second specific random result. It is envisaged that unsuccessful first wagers will be retained by the casino banker.

The first specific random result is compared with the second specific random result to determine a winning specific random result (first or second outcome). The winning specific random result is the specific random result corresponding to the longest odds or to a predetermined scheme, such as in poker.

In the second embodiment, if the first and second specific random results both include a dead man's hand or only one pair of the same indicia, a losing tie between the player and the banker of the casino is deemed to have occurred. In this instance, all the second wagers placed in the second betting areas 32 are retained by the casino. If, however, the first and second specific random results are the same but include an outcome of more than one pair of the same indicia, a winning tie between the player and the banker of the casino is deemed to have occurred. In this instance, all the second wagers placed by the players in the second betting areas 32 are paid out.

In the fourth embodiment a losing tie may be defined as one pair of the same indicia or two pairs of the same indicia. A winning tie is defined as any other match between the first and second specific random results.

Referring to FIG. 3 and the third embodiment of the invention, the first betting zone 20 is provided with a plurality of first betting areas 22, each first betting area 22 corresponding to the first specific random result obtainable by the first player, and a plurality of first betting areas 26, each first betting area 26 corresponding to the second specific random result obtainable by the second player. Each first betting area 26 is provided with markings identical with first betting area 22 to clearly indicate the corresponding likely random result and the designated odds paid if a successful first wager is placed in that particular first betting area 26.

Referring to FIG. 3, the second betting zone 30 includes a plurality of second betting areas 32 for placement of second wagers. In the third embodiment of the invention each second betting area 32 corresponds to either the first outcome 32*a* or the second outcome 32*c*. Each second betting area 32 is provided with markings to clearly indicate the corresponding outcome and the designated odds paid if a successful second wager is placed in that particular second betting area 32.

In the third embodiment of the invention, prior to casting the dice, the players place a first wager on one or more first betting areas 22, 26, and/or second wagers on second betting areas 32*a* or 32*c* on the playing surface 100. Once all the players have completed placing their first wagers, the first player is then permitted to roll the first set of five dice to obtain the first specific random result and the second player is then permitted to roll the second set of five dice to obtain the second specific random result. Depending on which indicia are shown on the upwardly turned faces of the dice, some of the first wagers will win, and others will lose. Successful first wagers are defined as those placed on first betting areas 22, 26 that correspond to the first and second specific random results, respectively. It is envisaged that successful first wagers will be paid according to the odds designated in the corresponding first betting areas 22, 26. Unsuccessful first wagers are defined as those placed on first betting areas 22, 26 that do not correspond to the first and second specific random results. It is envisaged that unsuccessful first wagers will be retained by the casino banker.

The first specific random result is compared with the second specific random result to determine the winning specific random result (first or second outcome). The winning specific random result is the specific random result corresponding to the longest odds or to a predetermined scheme, such as in poker. If the first and second specific random results both include a dead man's hand or only one pair of the same indicia, a losing tie between the first and second player is deemed to have occurred. In this instance, all second wagers placed in the second betting areas 32 are retained by the casino. If, however, the first and second specific random results are the same but include an outcome of more than one pair of the same indicia, a winning tie between the first and second players is deemed to have occurred. In this instance, all the second wagers placed by the players in the second betting areas 32 are paid out.

In the second or third embodiments, an additional hexahedral die may optionally be incorporated into the set of five dice. The additional hexahedral die includes five sides displaying different colours while a sixth side displays either a 'casino' logo or another symbol such as 'L'. The sixth side will determine if the player operating the random result generator and the banker, or the first and second players, lose to the house. The house will retain all first and second wagers if the player operating the random result generator and the banker, or the first and second players, both cast a die which shows the 'L' or 'casino' symbol. Players who do not operate the random result generator may place first wagers on certain combinations of colours, such as, a single or pair of a specific colour, or any pair of the same colour. It is envisaged that this particular option may be used as a replacement for the losing tie and/or the winning tie condition associated with the second wagers placed in the second betting area 32.

The third betting zone 40 includes a plurality of third betting areas 42, each third betting area 42 arranged in sequential and progressive order. It is envisaged that a plurality of players, preferably up to seven players will be permitted to place third wagers in the third betting areas 42. Each third betting area 42 is provided with markings to clearly indicate the amount paid if a successful third wager is placed in that particular third betting area 42. It will be understood that the amounts paid for a successful third wager increase progressively.

It is envisaged that the players may also place third wagers in the third betting area 42. The player who operates the random result generator must then attempt to throw a specific random result, equal to or higher than a predetermined specific random result for as many successive casts as possible. A successful cast results in the players who have placed third wagers advancing one level in the third betting area 42. At least one of the levels of the third betting area 42 is provided with markings which indicate that, having reached that particular level, the players are guaranteed to be paid at least a predetermined amount. Upon an unsuccessful cast they will forfeit the right to continue and will be paid the amount depending on the number of successful casts and the level of the third betting areas 42 that the players have achieved.

In the second and third embodiments of the invention, wherein the first and the second specific random result are generated, a comparison of the first and second specific random results, as previously described, will determine whether a player may progress to a successive level in the third betting area 42.

In the fourth embodiment, the modified deck of cards may optionally be provided with a plurality of promotional materials, for example corporate logos for the purposes of advertising, on the reverse side of the cards. The playing surface 100 is provided with a fourth betting zone 50 for the placement of a fourth wager. A fourth wager placed in the fourth betting zone 50 is successful if the promotional material found on the reverse side of the top card of the first set of cards dealt to the banker matches the promotional material found on the reverse side of the top card of the second set of cards dealt to the player. It is also envisaged that a successful fourth wager placed in the fourth betting zone 50 could be arranged to correspond with specific or predetermined combinations of promotional material found on the reverse side of any or all of the cards in the first and/or second set of cards. For example, the promotional material found on the reverse side of all five cards dealt in the first set of cards could be identical.

Further, it is envisaged that the invention includes an additional feature wherein players could participate in a progressive jackpot, the progressive jackpot operating in a known manner, which is arranged to correspond with two successive specific random results in which five identical indicia, for example, are cast by the player operating the random result generator. Alternatively, the progressive jackpot is arranged to correspond with a first specific random result and a successive second specific random result wherein the five upwardly turned faces of the first and second sets of dice or cards show five identical indicia. Furthermore, a predetermined amount could be paid to the player who cast, or is dealt, two successive specific random results in which five identical indicia appear.

Modifications and variations as would be apparent to a skilled addressee are deemed to be within the scope of the present invention

The invention claimed is:

1. A wagering game, comprising a random result generator, operated by one player, for generating a single specific random result from a finite set of random results, some random results being more likely than others; and a playing surface including a first betting zone corresponding to a plurality of likely random results, wherein a first wager placed in the first betting zone is won if the single specific random result matches the likely random result wagered in the first betting zone; a second betting zone, for placement of a second wager, corresponding to a first outcome and second outcome, wherein the first and second outcomes correspond to a comparison of the single specific random result with a predetermined specific random result; and a third betting zone comprising a plurality of a third betting areas, for placement of a third wager thereon, wherein the success of the third wager is dependent on the single specific random result being higher than the predetermined specific random result for a predetermined number of successive single specific random results.

2. The wagering game according to claim 1, characterized in that the first outcome corresponds to the specific random result being equal to or higher than a predetermined specific random result, and the second outcome corresponds to the specific random result being less than the predetermined specific random result.

3. The wagering game according to claim 1, characterized in that the first betting zone includes a plurality of first betting areas wherein each first betting area corresponds to the specific random result obtained by the random result generator.

4. The wagering game according to claim 1 characterized in that the random result generator comprises an electronic random result generator.

5. The wagering game according to claim 1, characterized in that the random result generator comprises a set of cards.

6. The wagering game according to claim 1, characterized in that the random result generator comprises a plurality of dice.

7. The wagering game according to claim 6, characterized in that the dice or cards are provided with indicia including numeric, alphabetic, pictorial symbols, colours, or indicative symbols.

8. The wagering game according to claim 7, characterized in that the cards are provided with additional indicia including promotional material located on a reverse side of the cards.

9. The wagering game according to claim 8 characterized in that the wagering games is provided with a fourth betting zone comprising a plurality of fourth betting areas for placement of a fourth wager thereon, wherein the success of the fourth wager is dependent on the additional indicia located on the reverse side of the cards corresponding with a predetermined scheme.

10. A wagering game, comprising a random result generator, operating by a first player for generating a first single specific random result from a finite set of random results and a second player for generating a second single specific random result from a finite set of random results, some random results being more likely than others; and a playing surface including a first betting zone corresponding to a plurality of likely random results, wherein a first wager placed in the first betting zone is won if the first or second single specific random result matches the likely random result wagered in the first betting zone, a second betting zone, for placement of a second wager, corresponding to a first outcome and a second outcome, wherein the first and second outcomes correspond to a comparison of the first single specific random result with the second single specific random result; and a third betting zone comprising a plurality of third betting areas, for placement of a third wager thereon, wherein the success of the third wager is dependent on the first or second specific random result being higher than a predetermined specific random result for a predetermined number of successive first or second specific random results.

11. The wagering game according to claim 10, characterized in that the first outcome corresponds to the first specific random result being higher than the second specific random result, and the second outcome corresponds to the second specific random result being higher than the first specific random result.

12. The wagering game according to claim 10, characterized in that the comparison allows for a tie between the first and second specific random results.

13. The wagering game according to claim 10, characterized in that the first betting zone includes a plurality of first betting areas wherein each first betting area corresponds to the specific random result obtained by the random result generator.

14. The wagering game according to claim 10, characterized in that the random result generator comprises an electronic random result generator.

15. The wagering game according to claim 10, characterized in that the random result generator comprises a set of cards.

16. The wagering game according to claim 10, characterized in that the random result generator comprises a plurality of dice.

17. The wagering game according to claim 16, characterized in that the dice or cards are provided with indicia Including numeric, alphabetic, pictorial symbols, colours, or indicative symbols.

18. The wagering game according to claim 17, characterized in that the cards are provided with additional indicia including promotional material located on a reverse side of the cards.

19. The wagering game according to claim 18 characterized in that the wagering games is provided with a fourth betting zone comprising a plurality of fourth betting areas for placement of a fourth wager thereon, wherein the success of the fourth wager is dependent on the additional indicia located on the reverse side of the cards corresponding with a predetermined scheme.

* * * * *